US006208826B1

(12) United States Patent
Yoshinaga et al.

(10) Patent No.: US 6,208,826 B1
(45) Date of Patent: Mar. 27, 2001

(54) TRANSFER DEVICE HAVING NOTCHES, METHOD AND IMAGE FORMING APPARATUS USING THE SAME TRANSFER DEVICE OR METHOD

(75) Inventors: Hiroshi Yoshinaga, Ichikawa; Kunihiro Ohyama, Kawasaki, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/318,822

(22) Filed: May 26, 1999

(30) Foreign Application Priority Data

Jun. 8, 1998 (JP) ..... 10-175436

(51) Int. Cl.[7] ..... G03G 15/16
(52) U.S. Cl. ..... 399/318; 399/313
(58) Field of Search ..... 399/318, 297, 399/310, 313

(56) References Cited

U.S. PATENT DOCUMENTS 5,153,654 * 10/1992 Yuminamochi et al. ..... 399/318

FOREIGN PATENT DOCUMENTS 1-196087 * 8/1989 (JP) .
2-166487 * 6/1990 (JP) .
4-328593 * 11/1992 (JP) .
5-53456 3/1993 (JP) .
7-237779 * 9/1995 (JP) .
9-80954 * 3/1997 (JP) .
2686267 8/1997 (JP) .
9-281819 * 10/1997 (JP) .
2847927 11/1998 (JP) .

* cited by examiner

*Primary Examiner*—Susan S. Y. Lee
(74) *Attorney, Agent, or Firm*—Oblon, Spivak, McCLelland, Maier & Neustadt, P.C.

(57) ABSTRACT

A transfer device includes a transfer member that forms a nip part between a rotary image carrier carrying an image and the transfer member and that transfers the image on the image carrier to a transfer material passing through the nip part. The transfer member has on the transfer surface thereof notches slanting relative to a direction perpendicular to the transfer surface. The transfer device further includes a pushing member to push the transfer member to the image carrier so as to oppose to a pushing force from the transfer material to the transfer member, and a driving force transmission device that transmits a driving force to the transfer member such that the transfer surface of the transfer member moves at a circumferential speed different from that of the image carrier. The notches of the transfer member are slanted in a direction relative to the direction perpendicular to the transfer surface such that alien substances substantially do not enter a concave portion of the notches when the transfer material moves relative to the transfer surface.

60 Claims, 7 Drawing Sheets

*FIG. 10*

| PUSHING FORCE TO TRANSFER ROLLER (N) | IMAGE SHIFT | NOTE |
|---|---|---|
| 16 | × | ONLY WHEN A TRANSFER SHEET IS FED FROM A MANUAL FEEDING UNIT |
| 24 | × | ONLY WHEN A THICK TRANSFER SHEET IS FED FROM A MANUAL FEEDING UNIT |
| 32 | × | ONLY AT A TRAILING EDGE OF A THICK TRANSFER SHEET FED FROM A MANUAL FEEDING UNIT |
| 40 | ○ | |
| 48 | ○ | |

× : "IMAGE SHIFT" OCCURS

○ : "IMAGE SHIFT" DOES NOT OCCUR

TRANSFER DEVICE HAVING NOTCHES, METHOD AND IMAGE FORMING APPARATUS USING THE SAME TRANSFER DEVICE OR METHOD

BACKGROUND OF THE INVENTION

1. Field of the Invention

This invention relates to a transfer device included in an image forming apparatus, method and image forming apparatus using the same.

2. Discussion of the Background

In an image forming apparatus, such as for example a copying machine, a printer, a facsimile machine or the like, a transfer device, such as for example a transfer roller, is provided to transfer a toner image formed on an image carrier of the apparatus to a transfer sheet conveyed to a transfer position between the image carrier and the transfer device. Relating to the image forming apparatus having a transfer roller, Japanese Patent Publication No. 2686267 of 1997 describes an apparatus with a transmission device which transmits driving force from an image carrier to a transfer roller such that a circumferential speed of the transfer roller is greater than that of the image carrier at a nip part between the transfer roller and the image carrier. With the above described configuration, an image is transferred to a transfer sheet without shifting even when the transfer sheet receives an impact while the image is transferred.

Furthermore, it is known that a transfer error such that a part of a character image is not transferred and thereby the character image has a blank portion therein can be reduced by creating a difference in the circumferential speed between the image carrier and the transfer device such as the transfer roller.

Generally, the transfer roller includes a metal shaft and an elastic body such as conductive foamed polyurethane surrounding the shaft. Because a nip part between the image carrier and a transfer surface of the transfer roller affects transfer performance, the tolerance of an outside diameter of the transfer roller must be accurately controlled. For this reason, generally in the process of making the transfer roller the elastic body is attached to the metal shaft with the outside diameter of the transfer roller made greater than desired, and then the elastic body is ground with a grindstone to have a desired outside diameter.

In the above described grinding process, it is known that, as illustrated in FIG. 8, notches 101 are formed on the transfer surface of a transfer roller 10 such that each notch slants at a certain angle relative to a direction perpendicular to the transfer surface of the transfer roller 10. A slanting direction of the notches 101 is hereinafter called a "notch direction" or a "direction of notches".

It is further known that the conveying force of the transfer roller 10 having the notches 101 falls over time when, as illustrated in FIG. 9, a photoconductive drum 1 as an image carrier and the transfer roller 10 rotate in the directions indicated by arrows C and D, respectively, a transfer sheet 8 as a recording material passes through a nip part between the photoconductive drum 1 and the transfer roller 10 in the direction indicated by an arrow B, the transfer roller 10 rotates with a circumferential speed greater than that of the photoconductive drum 1, and the notch 101 of the transfer roller 10 is slanted toward the moving direction of the transfer sheet 8 indicated by the arrow B. As a result of the reduction of the conveying force of the transfer roller 10, the following transfer errors occur: (1) the length of an image transferred to the transfer sheet 8 in the sheet advancing direction is magnified and reduced from that of an image formed on the image carrier 1 (hereinafter referred to as "magnification/reduction error"), (2) only a peripheral part of an image is transferred to the transfer sheet 8 but some portions in the center of the image are not transferred (hereinafter referred to as "blank image"), and (3) a position of the transferred image is shifted on the transfer sheet 8 (hereinafter referred to as "image shift").

The inventors have found a cause of the above-described transfer errors through intense study, as follows. Generally, a transfer sheet is attracted to a surface of a photoconductive drum as an image carrier by the electrostatic attraction force of the photoconductive drum and is thereby moved by the rotation of the drum. Therefore, when the transfer roller and the photoconductive drum rotate such that the circumferential speed of the transfer roller is greater than that of the photoconductive drum, the transfer sheet relatively moves in the direction opposite to the advancing direction of the transfer roller. When the slanting direction of the notch 101 of the transfer roller 10 is directed in the transfer sheet advancing direction indicated by the arrow B as illustrated in FIG. 9, alien substances around the facing part of the transfer sheet 8 and the transfer roller 10 are prone to enter the concave portion of the notch 101. For example, toner remaining on a part of the photoconductive drum 1 corresponding to a background portion of the transferred image, and paper dust enter the notch 101. Further, when the transfer sheet 8 to be conveyed to the transfer position jams and is not conveyed to the transfer position, a toner image formed on the surface of the photoconductive drum 1 directly contacts the transfer surface of the transfer roller 10, so that the toner enters the concave portion of the notch 101.

Furthermore, in the condition illustrated in FIG. 9, the slanting direction of the notch 101 is opposed to the moving direction of the transfer sheet 8 relative to the transfer roller 10, and the transfer roller 10 rubs against the backside of the transfer sheet 8. Thereby, paper dust is prone to be produced at the transfer position and enters the concave portion of the notch 101.

As a result of the above-described alien substances entering the concave portion of the notch 101, the frictional force of the transfer roller 10 acting on the transfer sheet 8 falls over time, so that the conveying force of the transfer roller 10 falls. Accordingly, the above-described transfer errors, such as, "magnification/reduction error", "blank image", and "image shift" are apt to occur. These transfer errors are prone to occur not only when the circumferential speed of the transfer roller is greater than that of the photoconductive drum but also when the circumferential speed of the transfer roller is smaller than that of the photoconductive drum, i.e., when there is a difference in the circumferential speed between the transfer roller and the photoconductive drum.

Japanese Patent publication No. 2847927 of 1998 describes another image transfer device included in an image forming apparatus in which a transfer roller has notches on the transfer surface thereof. In this image transfer device, because the transfer material conveying force of the transfer roller increases as the notches of the transfer roller are rubbed and thereby convex portions of the notches are reduced as the printing volume increases, the contact area between the transfer material and transfer roller increases. In order to address image quality problems caused by the increase of transfer material conveying speed, the transfer roller is disposed in relation to a surface of a photoconductive drum so that the transfer roller contacts and rotates in the direction where a surface frictional force of the transfer roller in the circumferential direction is large.

SUMMARY OF THE INVENTION

The present invention has been made in view of the above-discussed problems, and an object of the invention is to address these problems.

The preferred embodiments of the present invention provide a novel transfer device and method in which transfer errors are prevented. The preferred embodiments of the present invention further provide a novel image forming apparatus and method in which transfer errors are prevented.

According to a preferred embodiment of the present invention, a transfer device includes a transfer member having a transfer surface that forms a nip part between a rotary image carrier carrying an image and the transfer member, and that transfers the image on the image carrier to a transfer material passing through the nip part. The transfer member has on the transfer surface thereof notches slanting relative to a direction perpendicular to a surface of the transfer member. The transfer device further includes a pushing member to push the transfer member to the image carrier so as to oppose a pushing force from the transfer material to the transfer member, and a driving force transmission device that transmits a driving force to the transfer member such that the transfer surface of the transfer member moves at a circumferential speed different from that of the image carrier. The notches of the transfer member are slanted in a direction relative to the direction perpendicular to the transfer surface such that alien substances substantially do not enter a concave portion of the notches when the transfer material moves relative to the transfer surface.

According to the present invention, the notches of the transfer member may be slanted toward a relative moving direction of the transfer material relative to the transfer surface. That is, they are slanted towards the relative moving direction of the transfer material, relative to a direction perpendicular to the transfer surface, and when viewed in a direction of the length of the notches from their bases toward the transfer surface.

The transfer member may have an elastic layer containing cells with an average cell diameter in a range of about 50 $\mu$m to about 100 $\mu$m.

The driving force transmission device may be configured to make the circumferential speed of the transfer member greater than that of the image carrier. Further, the driving force transmission device may be configured to transmit a driving force of the image carrier to the transfer member.

The transfer device may further include a removing device that removes alien substances adhering to the transfer surface of the transfer member.

According to another preferred embodiment of the present invention, an image forming apparatus includes a rotary image carrier that carries an image and an image carrier driving device that rotates the image carrier. The image forming apparatus includes a transfer device having a transfer member having a transfer surface that forms a nip part between the image carrier and the transfer member and that transfers the image on the image carrier to a transfer material passing through the nip part. The transfer member has on the transfer surface thereof notches slanting at a certain angle relative to a direction perpendicular to a surface of the transfer member. The transfer device further includes a driving force transmission device that transmits a driving force to the transfer member such that the transfer surface of the transfer member moves at a circumferential speed different from that of the image carrier. The image forming apparatus further includes a bent sheet conveying path through which the transfer material is conveyed toward the nip part. The notches of the transfer member are slanted in a direction relative to the direction perpendicular to the transfer surface such that alien substances substantially do not enter a concave portion of the notches when the transfer material moves relative to the transfer surface, and the transfer material is conveyed toward the nip part with its leading edge portion bent toward the transfer member by being conveyed through the bent sheet conveying path.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 10 is a chart illustrating a result of an experiment explaining a relation between a pushing force to the transfer roller and the occurrence of image shift.

DESCRIPTION OF THE PREFERRED EMBODIMENTS

Figure 1:
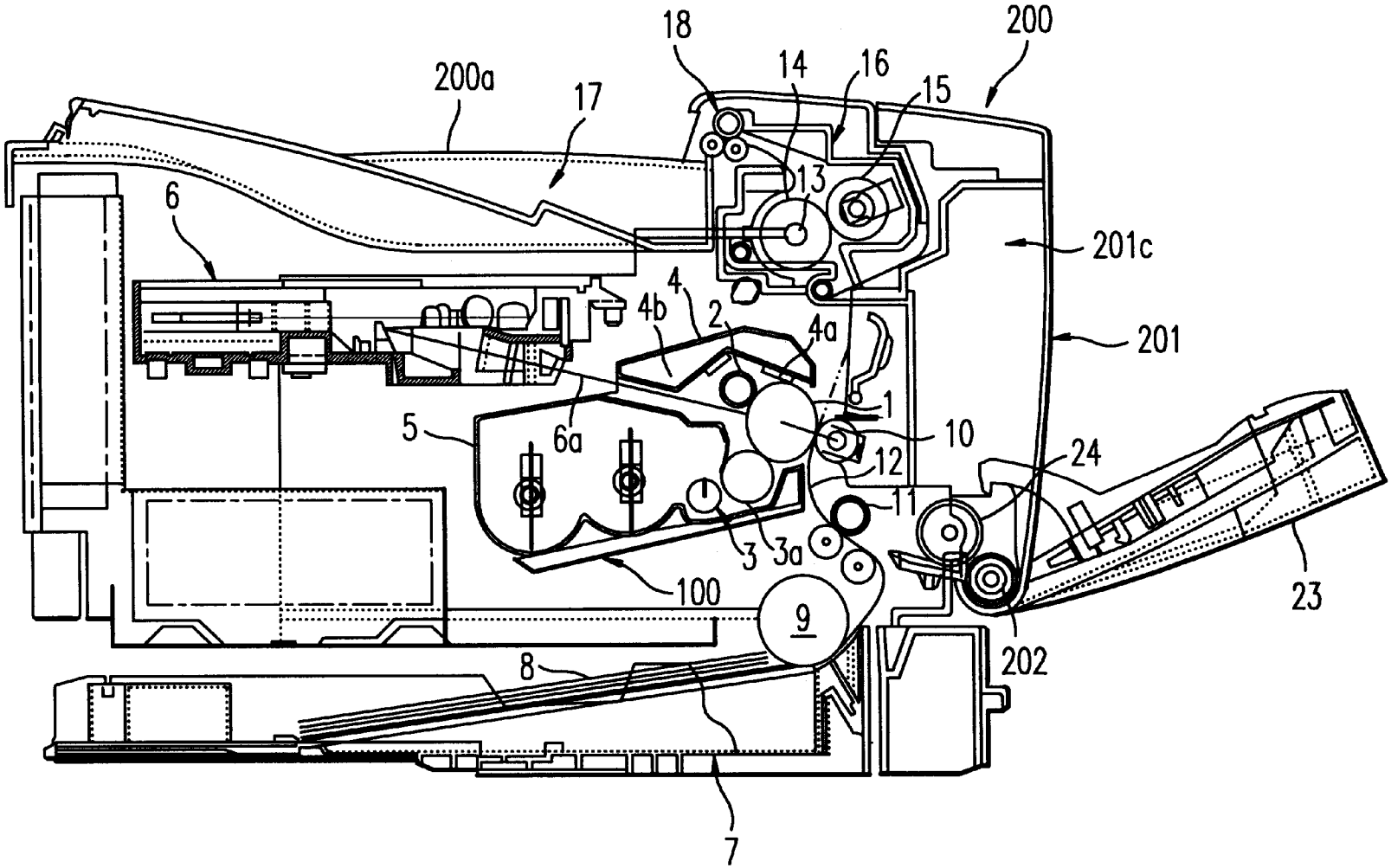
FIG. 1 is a schematic drawing illustrating an overall structure of a printer according to an embodiment of the present invention.

Referring now to the drawings, wherein like reference numerals designate identical or corresponding parts throughout the several views, an embodiment of the present invention applied to a laser printer (hereinafter referred to simply as a printer) as an image forming apparatus is now described.

FIG. 1 is a schematic drawing illustrating an overall structure of a printer according to an embodiment of the present invention. As illustrated in FIG. 1, a printer 200 includes a process cartridge 100 housing an image forming device forming an image on a transfer sheet as a recording material in an electrophotographic process. Specifically, the process cartridge 100 includes a housing 5 in which the following elements are integrally provided in a compact size: an OPC photoconductive drum 1 (hereinafter referred to as a "photoconductive drum 1") as an image carrier with a 30 mm diameter, a charging roller 2 as a charging device, a developing unit 3 as a developing device, and a cleaning unit 4 as a cleaning device.

At a side of the process cartridge 100, a latent image writing unit 6 which writes an electrostatic latent image on the surface of the photoconductive drum 1 is provided. In the latent image writing unit 6, a laser beam is emitted from a semiconductor laser (not shown) based on light signals corresponding to information of an image scanned by a scanner (not shown) or the like. The laser beam is deflected by a rotary polygonal mirror (not shown), passes through a focus and a correction lens (not shown), and is reflected by a mirror (not shown), so as to scan the surface of the photoconductive drum 1. Thereby, a light beam 6*a* corresponding to image information for each color forms an electrostatic latent image on the photoconductive drum 1.

Under the process cartridge 100 are a sheet feeding roller 9 and a pair of registration rollers 11. The sheet feeding roller 9 feeds a transfer sheet 8 accommodated in a sheet feeding cassette 7, sheet by sheet. The transfer sheet 8 fed from the sheet feeding roller 9 is kept on standby upstream of the photoconductive drum 1. The pair of registration rollers 11 refeeds the transfer sheet 8 in synchronization with the rotation of the photoconductive drum 1 at a timing such that a leading edge of the image formed on the photoconductive drum 1 and a leading edge of the transfer sheet 8 reach a nip part between the photoconductive drum 1 and a transfer surface of a transfer roller 10 at substantially the same time.

At an upper side of the process cartridge 100 is a fixing device 16 which includes a fixing roller 14 containing a heater 13 and a press roller 15. The fixing roller 14 and the press roller 15 are rotatably disposed facing and pressing each other for sandwiching a transfer sheet conveying path 12 therebetween. Further, at the downstream side of the fixing device 16 in the transfer sheet conveying direction is a sheet discharging roller 18. The sheet discharging roller 18 discharges the transfer sheet 8 passed through a nip between the fixing roller 14 and the press roller 15 to a stacker 17 as a sheet discharging tray formed at an upper portion of a main body case 200*a* of the printer 200.

In the printer 200 of the above-described configuration, the photoconductive drum 1 rotates, for example at a linear speed of 80 mm per second, and is uniformly charged by application of a voltage via the charging roller 2 while the photoconductive drum 1 is rotating. Then, the latent image writing unit 6 is driven based on the scanned image information, and thereby the image information is formed into an electrostatic latent image on the charged area (i.e., image forming area) of the photoconductive drum 1. The electrostatic latent image formed on the photoconductive drum 1 is developed with developer (toner) supplied by a developing roller 3*a* of the developing unit 3 and becomes a visible image (a toner image).

While forming a toner image on the photoconductive drum 1, the transfer sheet 8 is taken out of the sheet feeding cassette 7 by the sheet feeding roller 9 and is kept on standby with its leading edge abutting against a nip part of the pair of registration rollers 11. Then, the registration rollers 11 rotate to feed the transfer sheet 8, in synchronization with the rotation of the photoconductive drum 1, at a timing such that a leading edge of the toner image formed on the photoconductive drum 1 is aligned with a leading edge of the transfer sheet 8. Thereby, the transfer sheet 8 is conveyed to a transfer position formed at a nip between the photoconductive drum 1 and the rotating transfer roller 10 by being press-contacted with the photoconductive drum 1. The toner image on the photoconductive drum 1 is transferred to the transfer sheet 8 at the transfer position. Then the transferred image is fixed to the transfer sheet 8 passing between the fixing roller 14 and the press roller 15 of the fixing device 16, and the transfer sheet 8 is discharged onto the stacker 17 by the sheet discharging roller 18. On the other hand, residual toner, which remains on the photoconductive drum 1 without being transferred to the transfer sheet 8 in the toner image transfer process, is removed from the photoconductive drum 1 with a cleaning blade 4*a* of the cleaning unit 4 and is collected in a cleaning container 4*b*.

Further, an open/close cover 201 is provided with the main body case 200*a* of the printer 200, forms a part of the main body case 200*a*. The open/close cover 201 is supported by a cover shaft 202 and can open and close. A manual feeding unit 23 for manually feeding a transfer sheet is provided with the open/close cover 201. Particularly, the transfer sheets which are not suitable for feeding out from the sheet feeding cassette 7, such as for example a thick transfer sheet, a post card and a transparent film for use in an overhead projection device, are fed from the manual feeding unit 23. The manual feeding unit 23 is also supported by the cover shaft 202 and can open and close.

A transfer sheet fed from the manual feeding unit 23 is conveyed to the registration rollers 11 by rotation of a feeding roller 24 provided on the main body of the printer 200. When the manual feeding unit 23 is not used, it is housed in a manual feeding unit housing section 201*c* formed inside of the open/close cover 201.

Figure 2:
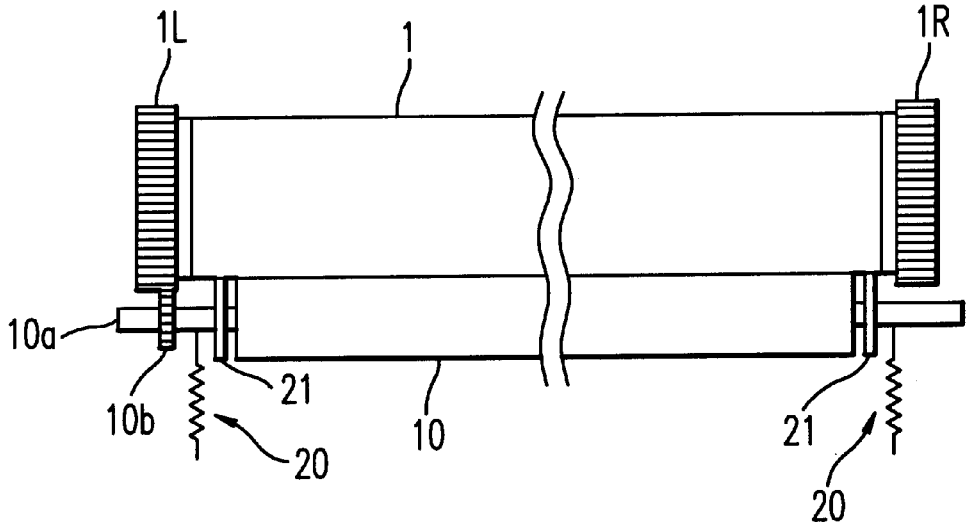
FIG. 2 is a schematic drawing for explaining a driving mechanism that drives a photoconductive drum and a transfer roller in the printer according to the embodiment of the present invention.

FIG. 2 is a schematic view for explaining a driving mechanism that drives the photoconductive drum 1 and the transfer roller 10 in the printer according to the embodiment of the present invention. Flanges 1L and 1R are provided, respectively, at both ends of the photoconductive drum 1 in the direction of a rotation axis thereof. The flanges 1L and 1R are of a shape such that the driving force of the photoconductive drum 1 or other members can be transmitted to another member, such as for example a gear. The flange 1R on the right side of the photoconductive drum 1 in FIG. 2 receives the driving force of a main motor (not shown) as an image carrier driving device, and thereby the photoconductive drum 1 is driven to rotate.

The transfer roller 10 is driven to rotate by a driving force transmission device by which the driving force of the photoconductive drum 1 is transmitted to the transfer roller 10. Specifically, the driving force transmission device includes the flange 1L on the left side of the photoconductive drum 1 in FIG. 2, and a driving gear 10*b* which is provided on the left side of a shaft 10*a* of the transfer roller 10 in FIG. 2 so as to be engaged with the flange 1L. The transmission of the driving force from the flange 1L to the driving gear 10*b* of the transfer roller 10 enables the transfer roller 10 to rotate. Further, the flange 1L and the driving gear 10*b* are made such that the circumferential speed of the transfer roller 10 is greater than that of the photoconductive drum 1. By so making the circumferential speed of the transfer roller 10 greater than that of the photoconductive drum 1, the toner image on the surface of the photoconductive drum 1 can be rubbed away from the surface of the photoconductive drum 1 and be transferred onto the transfer sheet 8 by the transfer roller 10 at the nip part between the photoconductive drum 1 and the transfer roller 10. Accordingly, a good quality image can be formed without causing "blank image".

In the printer according to the embodiment of the present invention, the transfer roller 10 is driven by the driving force transmitted from the photoconductive drum 1 with the above described driving force transmission device, and a separate driving source such as a motor for driving the transfer roller 10 is not necessary. Therefore, the configuration of the printer can be made simple.

Furthermore, in the printer of this embodiment, the transfer roller 10 has an elastic layer on the metal shaft 10*a* and is shaped to have a transfer surface with a desired diameter, for example, a 16 mm diameter, by grinding the elastic layer. The material of the elastic layer of the transfer roller 10 is conductive foamed polyurethane and its average cell diameter is in the range of 50 $\mu$m to 100 $\mu$m. This material of the transfer roller 10 is used because good cleaning results are obtained by applying a cleaning bias voltage to the transfer roller 10. Specifically, as a depth of the cells is small, toner and paper dust entered into a cell are easily moved to the photoconductive drum 1 when the cleaning bias voltage is applied to the transfer roller 10. Thereby transfer performance of the transfer roller 10 can be maintained. In addition, the transfer roller 10 is pushed to the photoconductive drum 1 with a pressure spring 20 from the side of the main body of the printer 200. Further, a gap roller 21 is provided at each end of the transfer roller 10 to regulate a pressure at the nip part between the transfer roller 10 and the photoconductive drum 1 when the transfer roller 10 is pushed to the photoconductive drum 1 with the pressure spring 20, such that the nip space is kept constant.

Figure 8:
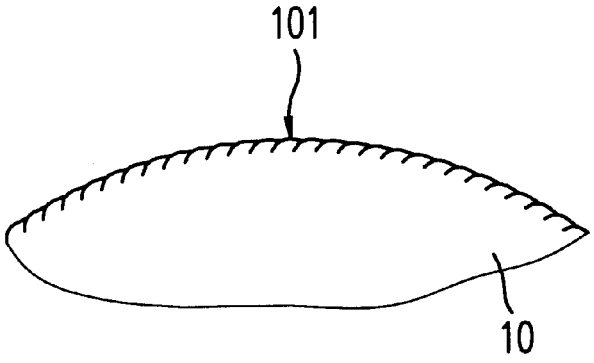
FIG. 8 is a schematic drawing for explaining notches on the surface of the transfer roller.

As described earlier, notches 101 are formed in the transfer surface of the transfer roller 10 and slant at a certain angle relative to a perpendicular direction to the transfer surface, as illustrated in FIG. 8. When alien substances, such as for example toner and paper dust, enter the concave portion of the notch 101, the condition of the transfer surface of the transfer roller 10 changes. Specifically, the frictional force falls and thereby the conveying force of the transfer roller 10 falls. As a result, transfer errors such as "magnification/reduction error", "blank image", and "image shift" occur.

Moreover, because of the following characteristics of the transfer roller 10 and the printer of this embodiment, toner and paper dust are prone to affect the transfer roller 10. First, in the printer of this embodiment, as illustrated in FIG. 1, the transfer sheet conveying path is short and bent in order to achieve a compact design and less time for outputting the first print. In either of two transfer sheet conveying paths, one from the sheet feeding cassette 7 and the other from the manual feeding unit 23, the transfer sheet reaches the transfer position with its leading edge portion bent toward the transfer roller 10 in the transfer sheet conveying path. Thereby, the leading edge portion of the transfer sheet relatively strongly presses the transfer surface of the transfer roller 10. Accordingly, the pushing force of the pressure spring 20 for pushing the transfer roller 10 to the photoconductive drum 1 is increased so as to oppose to the pressure from the transfer sheet to the transfer roller 10. As a result, the contact pressure becomes greater between the transfer sheet and the transfer roller 10, and thereby the transfer roller 10 rubs against the transfer sheet and paper dust is prone to be produced at the transfer position.

FIG. 10 illustrates the result of an experiment explaining a relation between a pushing force of the pressure spring 20 to the transfer roller 10 and occurrence of "image shift" on the transfer sheet. When the pushing force was 16 N (Newton), "image shift" occurred only when the transfer sheet was fed from the manual feeding unit 23. When the pushing force was 24 N, "image shift" occurred only when the thick transfer sheet was fed from the manual feeding unit 23. When the pushing force was 32 N, "image shift" occurred only at a trailing edge of the thick transfer sheet fed from the manual feeding unit 23. When the pushing force was 40 or 48 N, "image shift" did not occur for any transfer sheets used in the printer. In the printer of this embodiment, the pushing force of the pressure spring 20 to the transfer roller 10 is set to 48 N in consideration of other machine conditions.

Figure 3:
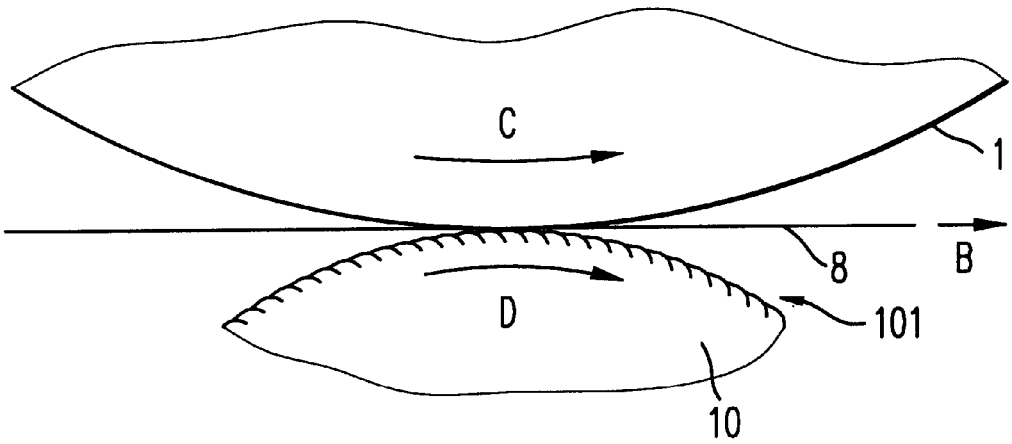
FIG. 3 is a schematic drawing for explaining a facing part of the photoconductive drum and the transfer roller of the printer of the present invention.

Secondly, with increasing environmental sensitivity among users, the use of recycled paper for printing has increased. As the fiber of the recycled paper is fine, paper dust is prone to be produced at the transfer position compared to ordinary paper. In the printer of this embodiment, the transfer roller 10 faces the photoconductive drum 1 such that the notches 101 are slanted in the direction in which alien substances substantially do not enter the concave portion of the notches 101 when the transfer sheet 8 moves relative to the transfer roller 10. Specifically, as illustrated in FIG. 3, the notches 101 are slanted in the moving direction of the transfer sheet 8 relative to a direction perpendicular to the transfer surface of the transfer roller 10. The detailed configuration and operation are described hereinafter.

Referring to FIG. 3, the photoconductive drum 1 rotates in the direction indicated by an arrow C, and the transfer roller 10 rotates in the direction indicated by an arrow D. As described earlier, the circumferential speed of the transfer roller 10 is set greater than that of the photoconductive drum 1. The transfer sheet 8 is attracted to the photoconductive drum 1 by electrostatic attraction force of the photoconductive drum 1, and is moved in the direction indicated by an arrow B by rotation of the photoconductive drum 1. The transfer sheet 8 moves at substantially the same speed as the circumferential speed of the photoconductive drum 1, or at a speed slightly faster than the circumferential speed of the photoconductive drum 1 (but slower than the circumferential speed of the transfer roller 10) due to the rotation of the transfer roller 10. The transfer sheet 8 in the above-described conditions relatively moves in a direction opposite to the direction indicated by the arrow B, relative to the transfer roller 10.

In the printer of this embodiment, as illustrated in FIG. 3, the transfer roller 10 faces the photoconductive drum 1 such that the notches 101 are slanted toward the relative moving direction of the transfer sheet 8 relative to the transfer roller 10, i.e., the notches 101 are slanted in a direction opposite to the actual moving direction B of the transfer sheet 8. As a result, alien substances are prevented from entering the concave portion of the notches 101. Accordingly, a change of the surface characteristic of the transfer surface of the transfer roller 10 over time due to entering of align substances into the concave portion, e.g., a change of the conveying force of the transfer roller 10 caused by reduction of the frictional force thereof, is avoided. Therefore, regardless of the lapse of time, transfer errors such as "magnification/reduction error", "blank image", and "image shift", can be prevented.

Further, when the notches 101 are slanted toward the relative moving direction of the transfer sheet 8 relative to the transfer roller 10, there is mush less possibility that a part of the transfer surface of the transfer roller 10 between the notches 101, (i.e., a convex portion) relatively strongly rubs against the transfer sheet 8, contrary to the case where the notches 101 are slanted in the opposite direction. As a result, the occurrence of paper dust can be lowered. Accordingly, the transfer errors caused by entering of paper dust into the concave portion of the notches 101 can be prevented.

Figure 4A:
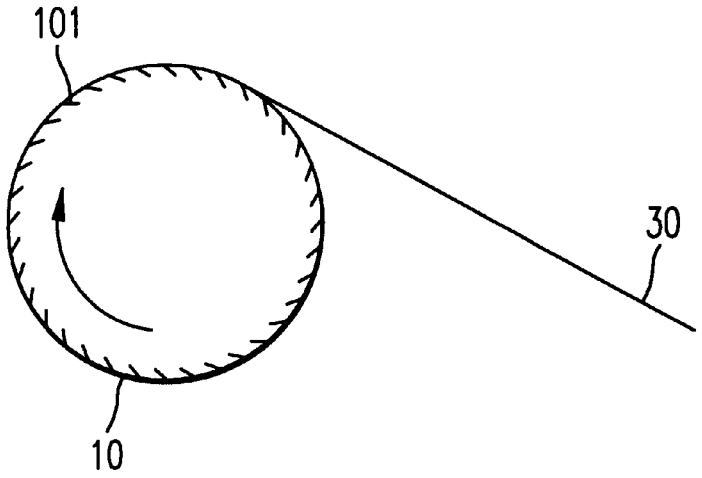
FIGS. 4A and 4B are schematic drawings for explaining a removing device of the printer of the present invention, FIG. 4A being a schematic view of a mylar sheet and the transfer roller, and FIG. 4B being a schematic view of a brush, the mylar sheet and the transfer roller.

Furthermore, in the printer of this embodiment, it is preferable to provide a removing device that removes alien substances adhering to the surface of the transfer roller 10, such as toner and paper dust. For example, as illustrated in FIG. 4A, a mylar sheet 30 as the removing device may be provided so as to contact the transfer surface of the transfer roller 10. Thereby, it can efficiently remove alien substances from the transfer surface of the transfer roller 10 and consequently prevent the alien substances from entering the concave portion of the notches 101 at the nip part between the transfer roller 10 and the photoconductive drum 1.

Figure 4B:
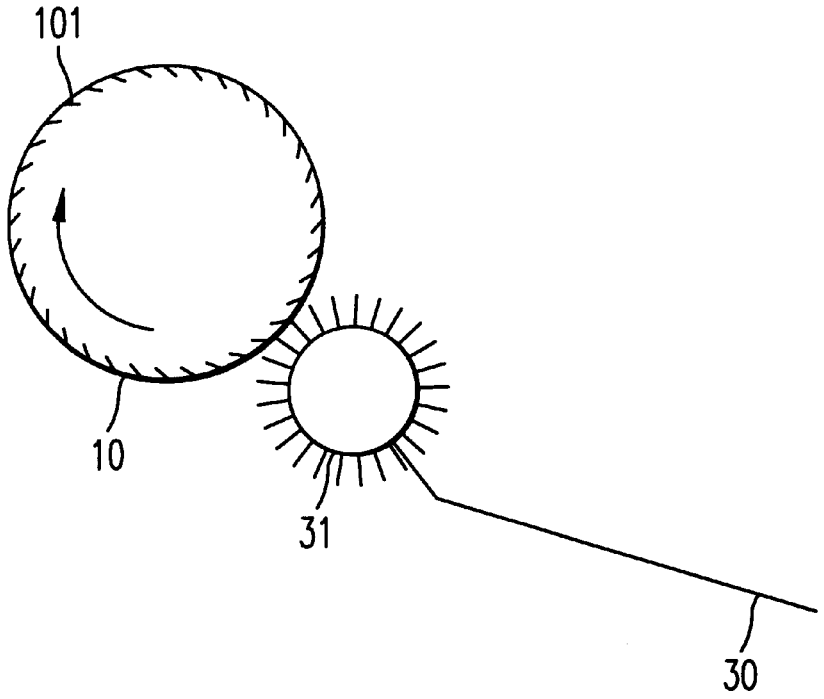

Further, another configuration of the removing device, e.g., a combination of a brush roller 31 and the mylar sheet 30, as illustrated in FIG. 4B, can efficiently remove alien substances entered into the concave portion of the notches 101. Specifically, tips of the bristles of the brush roller 31 is enter the concave portions of the notches 101 so as to scrape out alien substances in the concave portions. With the above-described configurations of the removing device illustrated in FIGS. 4A and 4B, occurrence of transfer errors, such as "magnification/reduction error", "blank image", and "image shift", can be more securely prevented.

The results of experiments of printing by the printer of FIG. 1 while changing the slanting direction of the notches 101 is next described. The first experiment is performed under the conditions in which the transfer roller 10 rotates such that the notches 101 thereof are slanted toward the relative moving direction of the transfer sheet 8 relative to the transfer surface of the transfer roller 10 as illustrated in FIG. 3, and A4 sized sheets are successively printed with the sheets fed in the landscape orientation. In this experiment, the "coefficient of friction" of the surface of the transfer roller 10, a "blank image rank", and a change of "magnification/reduction error" are periodically observed after a certain number of the sheets are fed. Results of the first experiment are illustrated by the lines with open circles in FIGS. 5, 6 and 7.

Figure 5:
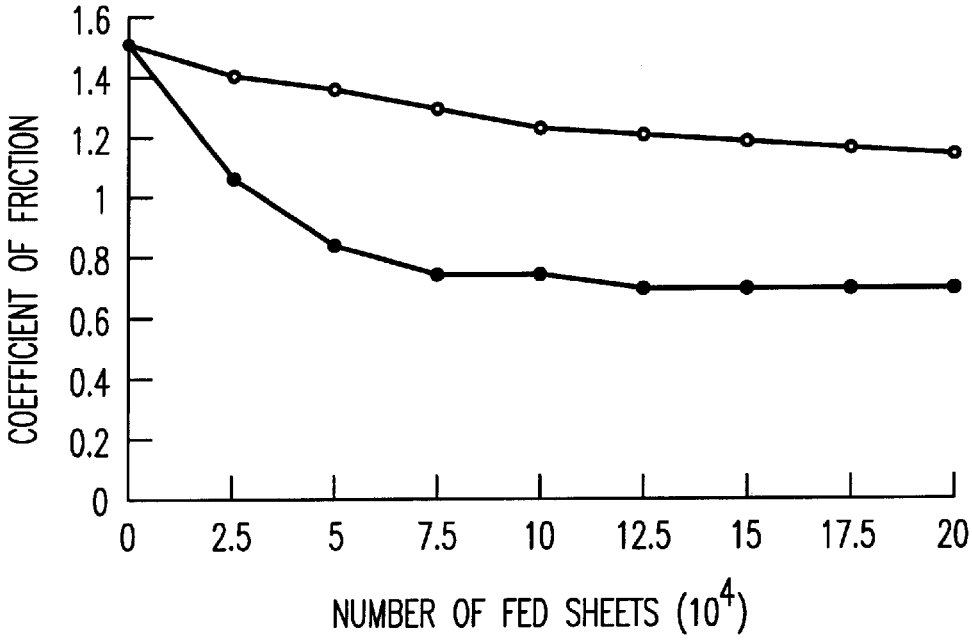
FIG. 5 is a graph illustrating a result of a change of coefficient of friction according to the number of fed sheets in first and second experiments.
Figure 6:
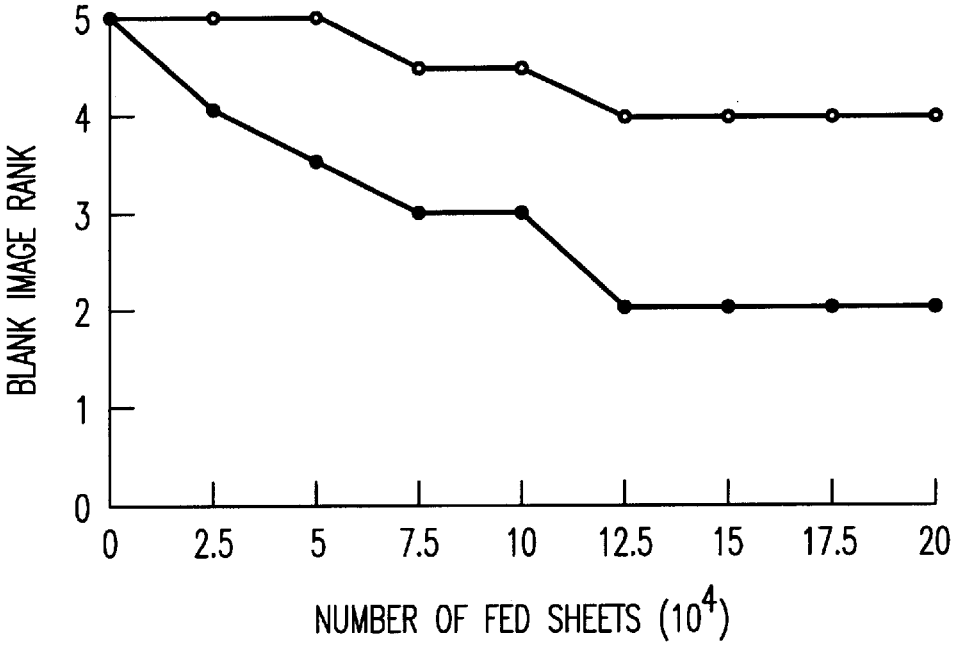
FIG. 6 is a graph illustrating a result of a change of blank image rank according to the number of fed sheets in the first and second experiments.

Referring to FIG. 5, the value of the coefficient of friction of the surface of the transfer roller 10 in the printer according to the present invention is desired to be "1.0" or more. As illustrated in FIG. 5, the coefficient of friction is kept above the desired value even when the number of printed sheets reaches 200,000. In FIG. 6, as the number of "blank. image rank" becomes greater, occurrence of blank image becomes less. The rank 5 indicates no occurrence of blank image. In the printer of this embodiment, the allowable rank is 4 or more, and the rank of 3.5 or less is considered an inadequate image. As illustrated in FIG. 6, the occurrence of the blank image according to the invention is kept above 4.

Figure 7:
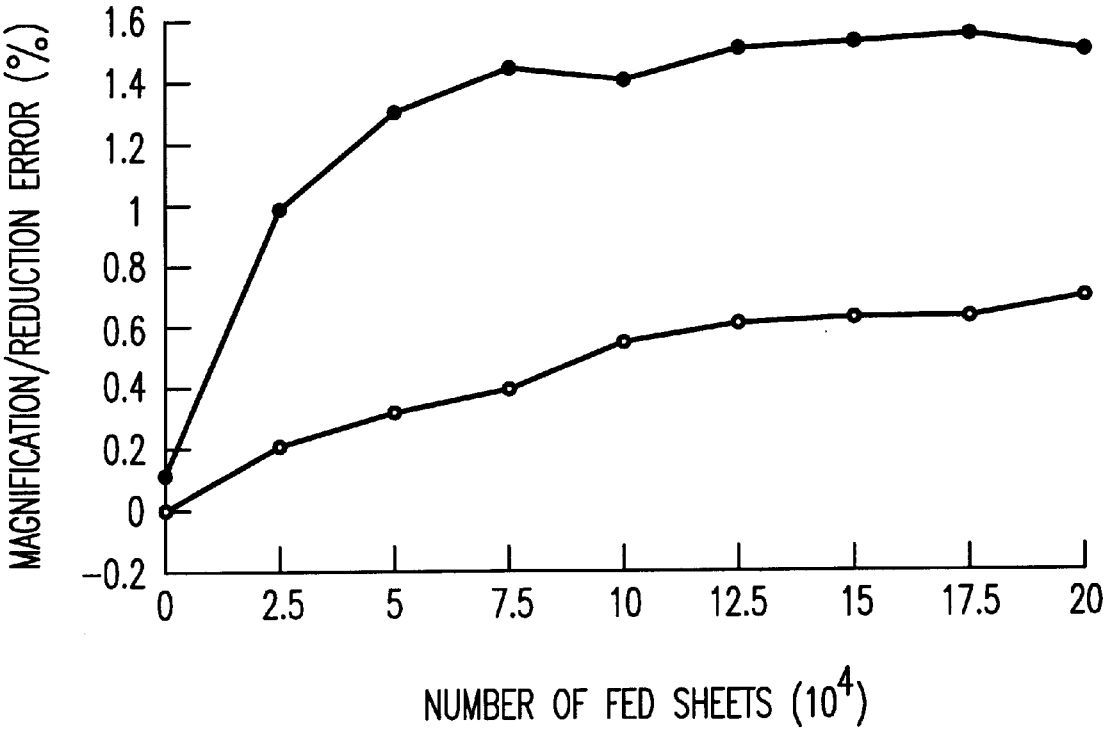
FIG. 7 is a graph illustrating a result of a change of magnification/reduction error according to the number of fed sheets in the first and second experiments.

Referring further to FIG. 7, the magnification/reduction error indicates a difference in the magnification and reduction of the length in the sheet advancing direction of the image transferred to the transfer sheet 8 from the photoconductive drum 1. Assuming that L1 represents a "theoretical image length" and L2 represents a "length of image transferred to the transfer sheet", "magnification/reduction error" is given by the following formula:

$$\text{Magnification/reduction error } (\%)=(L2-L1)/L1\times 100$$

In the printer of this embodiment, the value of the magnification/reduction error is kept below 1% as illustrated in FIG. 7.

Figure 9:
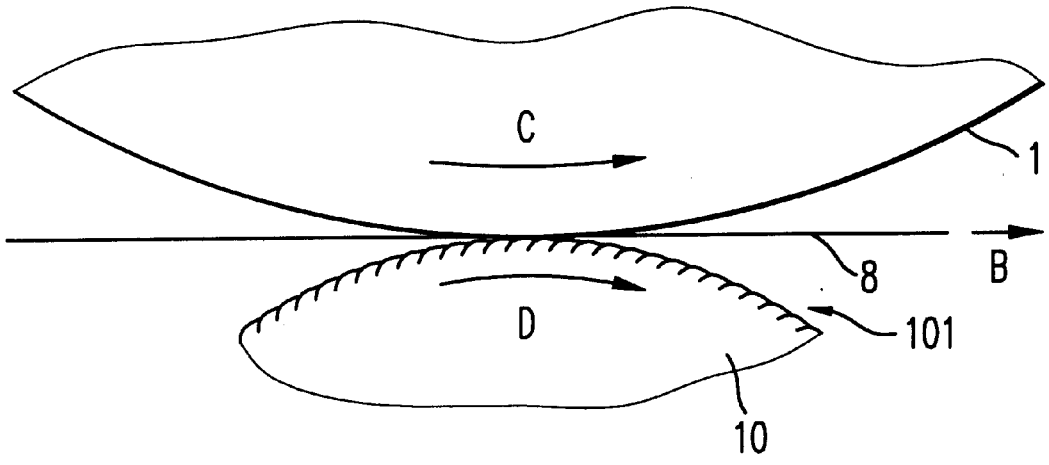
FIG. 9 BACKGROUND ART
FIG. 9 is a schematic drawing for explaining a facing part of a photoconductive drum and a transfer roller of a background transfer device.

The second experiment was performed with the transfer roller 10 rotating such that the notches 101 are slanted in the opposite direction, i.e., in the actual moving direction B of the transfer surface of the transfer sheet 8 as illustrated in FIG. 9, and A4 sized sheets were successively printed with the sheets fed in landscape orientation. The second experiment was carried out like the first experiment except for the direction of the notches 101. Results of the second experiment are illustrated by the lines with black solid circles in FIGS. 5, 6, and 7.

In the second experiment, as illustrated in FIG. 6, the "blank image rank" was 3.5 after feeding 50,000 sheets. Further, after feeding 125,000 sheets, the rank fell to 2. Further, referring to FIG. 7, the "magnification/reduction error" was 1.0% after feeding 25,000 sheets, and 1.3% after feeding 50,000 sheets, which is well over the desired value. In order to investigate the cause for the occurrence of the blank image and the increase of the magnification/reduction error in the second experiment, a component of the surface of the transfer roller 10 was analyzed at the time of feeding 50,000 sheets. As a result, calcium carbonate and talc, which are the components of a sheet and of toner, were detected. Further, it was found that the "coefficient of friction" of the surface of the transfer roller 10 dropped to 0.83 from 1.5 (initial value) after feeding 50,000 sheets, as illustrated in FIG. 5.

On the other hand, in the first experiment, the "blank image rank" was kept as 4 and more, and the "magnification/reduction error" was kept within 1% until 200,000 sheets were fed. As for the second experiment, a component of the surface of the transfer roller 10 was analyzed at the time of 50,000 sheet feeding. As a result, calcium carbonate, talc, and a composition of toner were also detected. However, the amounts of the calcium carbonate and talc were respectively about one-third of those in the second experiment, and the amount of the composition of toner was about a half of that in the second experiment. Further, it was found that the "coefficient of friction" of the surface of the transfer roller 10 was still at a sufficient level although it dropped to 1.34 from 1.5 (initial value) after feeding 50,000 sheets, as illustrated in FIG. 5.

According to the results of the first and second experiments as described above, when the notches 101 of the transfer surface of the transfer roller 10 are slanted in the direction opposite to the relative moving direction of the transfer sheet 8 relative to the transfer roller 10, the "coefficient of friction" of the surface of the transfer roller 10 significantly drops, and thereby inadequate images are produced. On the other hand, when the notches 101 are slanted toward the relative moving direction of the transfer sheet 8 relative to the transfer surface of the transfer roller 10, good quality images can be maintained until 60,000 to 80,000 sheets have been fed, which equals to the life of the transfer roller 10.

The figures represented in the first and second experiments are specific to the printer in the experiments, and may change depending on the linear speed of the photoconductive drum, the material of the transfer device, and etc.

In the above image forming apparatus according to the invention, though a transfer roller is used as the transfer device, the present invention can be applied to an image forming apparatus using other types of transfer devices, such as, for example, a transfer belt.

Obviously, numerous additional modifications and variations of the present invention are possible in light of the above teachings. It is therefore to be understood that within the scope of the appended claims, the present invention may be practiced otherwise than as specifically described herein.

This document is based on Japanese Patent Application No.10-175436 filed in the Japanese Patent Office on Jun. 8, 1998, the entire contents of which are hereby incorporated by reference.

What is claimed as new and is desired to be secured by Letters Patent of the United States:

1. A transfer device, comprising:

a transfer member having a transfer surface that forms a nip part between a rotary image carrier carrying an image and the transfer member so as to transfer the image on the image carrier to a transfer material passing through the nip part, the transfer member having on the transfer surface thereof notches slanting relative to a direction perpendicular to the transfer surface;

a pushing member positioned to push the transfer member to the image carrier so as to oppose a pushing force from the transfer material to the transfer member; and a driving force transmission device that transmits a driving force to the transfer member Such that the transfer surface of the transfer member moves at a circumferential speed different from that of the image carrier, wherein the notches of the transfer member are slanted in a direction relative to the direction perpendicular to the transfer surface, such that alien substances substantially are not caused to enter a concave portion of the notches by the transfer material moving relative to the transfer surface.

2. The transfer device according to claim 1, wherein the notches are slanted toward a moving direction of the transfer material relative to the transfer surface.

3. The transfer device according to claim 1, wherein the transfer member has an elastic layer containing cells with an average cell diameter in a range of about 50 $\mu$m to about 100 $\mu$m.

4. The transfer device according to claim 1, wherein the circumferential speed of the transfer member is greater than that of the image carrier.

5. The transfer device according to claim 1, wherein the driving force transmission device transmits a driving force of the image carrier to the transfer member.

6. The transfer device according to claim 1, further comprising an alien substance removing device.

7. An image forming apparatus, comprising:

a rotary image carrier that carries an image;

an image carrier driving device that rotates the image carrier;

a transfer device including a transfer member having a transfer surface that forms a nip part between the image carrier and the transfer member and that transfers the image on the image carrier to a transfer material passing through the nip part, the transfer member having on the transfer surface thereof notches slanting relative to a direction perpendicular to the transfer surface; and a driving force transmission device that transmits a driving force to the transfer member such that the transfer surface moves at a circumferential speed different from that of the image carrier; and a bent sheet conveying device configured for conveying the transfer material to the nip part, wherein the notches of the transfer member are slanted in a direction relative to the direction perpendicular to the transfer surface, such that alien substances substantially are not caused to enter a concave portion of the notches when by the transfer material moving relative to the transfer surface, and the transfer material is conveyed toward the nip part with its leading edge portion bent toward the transfer member by being conveyed through the bent sheet conveying device.

8. The image forming apparatus according to claim 7, wherein the notches are slanted toward a relative moving direction of the transfer material relative to the transfer surface.

9. The image forming apparatus according to claim 7, wherein the transfer member has an elastic layer containing cells with an average cell diameter in a range of about 50 $\mu$m to about 100 $\mu$m.

10. The image forming apparatus according to claim 7, wherein the circumferential speed of the transfer surface is greater than that of the image carrier.

11. The image forming apparatus according to claim 7, wherein the driving force transmission device transmits a driving force of the image carrier to the transfer member.

12. The image forming apparatus according to claim 7, the transfer device further including an alien substance removing device.

13. The image forming apparatus according to claim 7, wherein recycled paper is used as the transfer material.

14. An image forming apparatus, comprising:

a rotary image carrier capable of carrying an image;

an image carrier driving device that rotates the image carrier;

a transfer device including a transfer member having a transfer surface that forms a nip part between the image carrier and the transfer member so as to transfer the image on the image carrier to a transfer material passing through the nip part, the transfer member having on the transfer surface notches slanting relative to a direction perpendicular to the transfer surface;

a pushing member positioned to push the transfer member to the image carrier so as to oppose to a pushing force from the transfer material to the transfer member; and a driving force transmission device that transmits a driving force to the transfer member such that the transfer surface of the transfer member moves at a circumferential speed different from that of the image carrier, wherein the notches of the transfer member are slanted in a direction relative to the direction perpendicular to the transfer surface, such that alien substances substantially are not caused to enter a concave portion of the notches by the transfer material moving relative to the transfer surface.

15. The image forming apparatus according to claim 14, wherein the notches are slanted toward a relative moving direction of the transfer material relative to the transfer surface.

16. The image forming apparatus according to claim 14, wherein the transfer member has an elastic layer containing cells with an average cell diameter in a range of about 50 $\mu$m to about 100 $\mu$m.

17. The image forming apparatus according to claim 14, wherein the circumferential speed of the transfer member is greater than that of the image carrier.

18. The image forming apparatus according to claim 14, wherein the driving force transmission device transmits a driving force of the image carrier to the transfer member.

19. The image forming apparatus according to claim 14, the transfer device further including an alien substance removing device.

20. The image forming apparatus according to claim 14, wherein recycled paper is used as the transfer material.

21. A transfer device, comprising:

transfer means for forming a nip part between a rotary image carrier carrying an image and a transfer surface of the transfer means and for transferring the image on the image carrier to a transfer material passing through the nip part, the transfer means having on a surface thereof notches slanting relative to a direction perpendicular to the transfer surface;

means for pushing the transfer means to the image carrier so as to oppose to a pushing force from the transfer material to the transfer means; and driving force transmission means for transmitting a driving force to the transfer means such that a surface of the transfer means moves at a circumferential speed different from that of the image carrier, wherein the notches of the transfer means are slanted in a direction relative to the direction perpendicular to the transfer surface, such that alien substances substantially are not caused to enter a concave portion of the notches by the transfer material moving relative to the transfer surface.

22. The transfer device according to claim 21, wherein the notches are slanted toward a relative moving direction of the transfer material relative to the transfer surface.

23. The transfer device according to claim 21, wherein the transfer means has an elastic layer containing cells with an average cell diameter in a range of about 50 $\mu$m to about 100 $\mu$m.

24. The transfer device according to claim 21, wherein the driving force transmission means makes the circumferential speed of the transfer means greater than that of the image carrier.

25. The transfer device according to claim 21, wherein the driving force transmission means transmits a driving force of the image carrier to the transfer means.

26. The transfer device according to claim 21, further comprising means for removing alien substances adhering to the transfer surface of the transfer means.

27. An image forming apparatus, comprising:

image carrier means for carrying an image;

image carrier driving means for rotating the image carrier means;

transfer means for transferring the image on the image carrier means to a transfer material, the transfer means including transfer member means for forming a nip part between the image carrier means and the transfer member means and for transferring the image on the image carrier means to the transfer material passing through the nip part, the transfer member means having on a transfer surface thereof notches slanting relative to a direction perpendicular to the transfer surface;

driving force transmission means for transmitting a driving force to the transfer member means such that the transfer surface of the transfer member means moves at a circumferential speed different from that of the image carrier means; and bent sheet conveying means for conveying the transfer material to the nip part, wherein the notches of the transfer member means are slanted in a direction relative to the direction perpendicular to the transfer surface such that alien substances substantially are not caused to enter a concave portion of the notches by the transfer material moving relative to the transfer surface, and the transfer material is conveyed toward the nip part with its leading edge portion bent toward the transfer member means by being conveyed through the bent sheet conveying means.

28. The image forming apparatus according to claim 27, wherein the notches are slanted toward a relative moving direction of the transfer material relative to the transfer surface.

29. The image forming apparatus according to claim 27, wherein the transfer member means has an elastic layer containing cells with an average cell diameter in a range of about 50 $\mu$m to about 100 $\mu$m.

30. The image forming apparatus according to claim 27, wherein the driving force transmission means is configured to make the circumferential speed of the transfer member means greater than that of the image carrier means.

31. The image forming apparatus according to claim 27, wherein the driving force transmission means transmits a driving force of the image carrier means to the transfer member means.

32. The image forming apparatus according to claim 27, the transfer means further including means for removing alien substances adhering to the transfer surface of the transfer member means.

33. The image forming apparatus according to claim 27, wherein recycled paper used as the transfer material.

34. An image forming apparatus, comprising:

image carrier means for carrying an image;

image carrier driving means for rotating the image carrier means;

transfer means for transferring the image on the image carrier means to a transfer material, the transfer means including transfer member means for forming a nip part between the image carrier means and a transfer surface of the transfer member means and for transferring the image on the image carrier means to the transfer material passing through the nip part, the transfer member means having on the transfer surface thereof notches slanting relative to a direction perpendicular to the transfer surface;

means for pushing the transfer member means to the image carrier means so as to oppose to a pushing force from the transfer material to the transfer member means; and driving force transmission means for transmitting a driving force to the transfer member means such that the transfer surface of the transfer member means moves at a circumferential speed different from that of the image carrier means, wherein the notches of the transfer member means are slanted in a direction relative to the direction perpendicular to the transfer surface such that alien substances substantially are not caused to enter a concave portion of the notches by the transfer material moving relative to the transfer surface.

35. The image forming apparatus according to claim 34, wherein the notches are slanted toward a relative moving direction of the transfer material relative to the transfer surface.

36. The image forming apparatus according to claim 34, wherein the transfer member means has an elastic layer containing cells with an average cell diameter in a range of about 50 $\mu$m to about 100 $\mu$m.

37. The image forming apparatus according to claim 34, wherein the driving force transmission means makes the circumferential speed of the transfer member means greater than that of the image carrier means.

38. The image forming apparatus according to claim 34, wherein the driving force transmission means transmits a driving force of the image carrier means to the transfer member means.

39. The image forming apparatus according to claim 34, the transfer means further including means for removing alien substances adhering to the transfer surface of the transfer member means.

40. The image forming apparatus according to claim 34, wherein recycled paper is used as the transfer material.

41. A method of transferring an image on an image carrier to a transfer material passing through a nip part between the image carrier and a transfer surface of a transfer member having on the transfer surface notches slanting relative to a direction perpendicular to the transfer surface, the method comprising steps of:

moving the transfer surface of the transfer member at a circumferential speed different from that of the image carrier; and pushing the transfer member to the image carrier so as to oppose to a pushing force from the transfer material to the transfer member, wherein the notches of the transfer member are slanted in a direction relative to the direction perpendicular to the transfer surface such that alien substances substantially are not caused to enter a concave portion of the notches by the transfer material moving relative to the transfer surface.

42. The transferring method according to claim 41, wherein the notches are slanted toward a relative moving direction of the transfer material relative to the transfer surface.

43. The transferring method according to claim 41, wherein the transfer member has an elastic layer containing cells with an average cell diameter in a range of about 50 $\mu$m to about 100 $\mu$m.

44. The transferring method according to claim 41, wherein the circumferential speed of the transfer surface is greater than that of the image carrier in the moving step.

45. The transferring method according to claim 41, wherein a driving force of the image carrier is transmitted to the transfer member to move the transfer surface of the transfer member in the moving step.

46. The transferring method according to claim 41, further comprising a step of removing alien substances adhering to the transfer surface of the transfer member.

47. A method of forming an image in an image forming apparatus, comprising steps of:

moving a transfer surface of a transfer member, the transfer surface having notches slanting relative to a direction perpendicular to the transfer surface, such that the transfer surface moves at a circumferential speed different from that of an image carrier carrying an image;

conveying a transfer material to a nip part between the image carrier and the transfer surface through a bent sheet conveying path; and passing the transfer material through the nip part to transfer the image on the image carrier to the transfer material;

wherein the notches of the transfer member are slanted in a direction relative to the direction perpendicular to the transfer surface such that alien substances substantially are not caused to enter a concave portion of the notches by the transfer material moving relative to the transfer surface, and the transfer material is conveyed toward the nip part with its leading edge portion bent toward the transfer member by being conveyed through the bent sheet conveying path.

48. The image forming method according to claim 47, wherein the notches are slanted toward a relative moving direction of the transfer material relative to the transfer surface.

49. The image forming method according to claim 47, wherein the transfer member has an elastic layer containing cells with an average cell diameter in a range of about 50 $\mu$m to about 100 $\mu$m.

50. The image forming method according to claim 47, wherein the circumferential speed of the transfer surface is greater than that of the image carrier in the moving step.

51. The image forming method according to claim 47, wherein a driving force of the image carrier is transmitted to the transfer member to move the transfer surface of the transfer member in the moving step.

52. The image forming method according to claim 47, further comprising a step of removing alien substances adhering to the transfer surface of the transfer member.

53. The image forming method according to claim 47, wherein recycled paper is used as the transfer material.

54. A method of forming an image in an image forming apparatus, comprising steps of:

moving a transfer surface of a transfer member, the transfer surface having notches slanting relative to a direction perpendicular to the transfer surface, such that the transfer surface moves at a circumferential speed different from that of an image carrier carrying an image;

passing a transfer material through a nip part between the image carrier and the transfer surface to transfer the image on the image carrier to the transfer material; and pushing the transfer member to the image carrier so as to oppose to a pushing force from the transfer material to the transfer member, wherein the notches of the transfer member are slanted in a direction relative to the direction perpendicular to the transfer surface such that alien substances substantially are not caused to enter a concave portion of the notches by the transfer material moving relative to the transfer surface.

55. The image forming method according to claim 54, wherein the notches are slanted toward a relative moving direction of the transfer material relative to the transfer surface.

56. The image forming method according to claim 54, wherein the transfer member has an elastic layer containing cells with an average cell diameter in a range of about 50 $\mu$m to about 100 $\mu$m.

57. The image forming method according to claim 54, wherein the circumferential speed of the transfer surface is greater than that of the image carrier in the moving step.

58. The image forming method according to claim 54, wherein a driving force of the image carrier is transmitted to the transfer member to move the surface of the transfer member in the moving step.

59. The image forming method according to claim 54, further comprising a step of removing alien substances adhering to the transfer surface of the transfer member.

60. The image forming method according to claim 54, wherein recycled paper is used as the transfer material.

* * * * *